US010775081B2

(12) United States Patent
Akaiwa et al.

(10) Patent No.: US 10,775,081 B2
(45) Date of Patent: Sep. 15, 2020

(54) HEAT EXCHANGER AND AIR CONDITIONER

(71) Applicant: Mitsubishi Electric Corporation, Tokyo (JP)

(72) Inventors: Ryota Akaiwa, Tokyo (JP); Shinya Higashiiue, Tokyo (JP); Takashi Okazaki, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 25 days.

(21) Appl. No.: 16/078,687

(22) PCT Filed: Mar. 17, 2016

(86) PCT No.: PCT/JP2016/058533
§ 371 (c)(1),
(2) Date: Aug. 22, 2018

(87) PCT Pub. No.: WO2017/158795
PCT Pub. Date: Sep. 21, 2017

(65) Prior Publication Data

US 2019/0049162 A1 Feb. 14, 2019

(51) Int. Cl.
*F25B 39/02* (2006.01)
*F25D 17/06* (2006.01)
(Continued)

(52) U.S. Cl.
CPC ..... *F25B 39/02* (2013.01); *F25B 39/00* (2013.01); *F25D 17/067* (2013.01); *F28D 1/053* (2013.01);
(Continued)

(58) Field of Classification Search
CPC ..... F25B 39/00; F25B 39/02; F25B 13/00; F25D 17/067; F28D 1/053;
(Continued)

(56) References Cited

U.S. PATENT DOCUMENTS 3,190,352 A * 6/1965 Simpelaar ..... F28F 1/14 165/134.1
2004/0003619 A1* 1/2004 Lee ..... F28D 5/02 62/305
2008/0202153 A1 8/2008 Watanabe

FOREIGN PATENT DOCUMENTS

CN 105021069 A 11/2015
JP 09-280754 A 10/1997
(Continued)

OTHER PUBLICATIONS

U.S. Appl. No. 15/775,130, filed May 10, 2018, Akaiwa et al.
(Continued)

*Primary Examiner* — Joel M Attey
(74) *Attorney, Agent, or Firm* — Posz Law Group, PLC

(57) ABSTRACT

The heat exchanger includes at least one heat transfer tube which is provided to extend in a first direction and in which refrigerant flows, a fin which is connected to the heat transfer tube and has a first region and a second region which are located windward of the heat transfer tube in a second direction crossing the first direction, and a first guide member provided to extend in the first direction. The first region and the second region are spaced apart from each other in a third direction crossing the first direction and the second direction. The first guide member is disposed between the first region and the second region in the third direction. Of the heat transfer tube and the first guide member, the first guide member is disposed most windward in the second direction.

13 Claims, 8 Drawing Sheets

(51) Int. Cl.

| | |
|---|---|
| ***F28D 1/053*** | (2006.01) |
| ***F28F 1/02*** | (2006.01) |
| ***F28F 1/30*** | (2006.01) |
| ***F28F 1/32*** | (2006.01) |
| ***F28F 17/00*** | (2006.01) |
| ***F25B 39/00*** | (2006.01) |
| ***F28F 1/12*** | (2006.01) |
| *F25B 13/00* | (2006.01) |

(52) U.S. Cl.
CPC ..... *F28D 1/05383* (2013.01); *F28F 1/02* (2013.01); *F28F 1/022* (2013.01); *F28F 1/128* (2013.01); *F28F 1/30* (2013.01); *F28F 1/32* (2013.01); *F28F 17/005* (2013.01); *F25B 13/00* (2013.01)

(58) Field of Classification Search
CPC ..... F28D 1/05383; F28F 1/02; F28F 1/022; F28F 1/128; F28F 1/30; F28F 1/32; F28F 1/22; F28F 17/005
USPC ..... 165/133
See application file for complete search history.

(56) References Cited

FOREIGN PATENT DOCUMENTS

| | | | |
|---|---|---|---|
| JP | 10-062086 | A | 3/1998 |
| JP | 2000-241093 | A | 9/2000 |
| JP | 2006-046698 | A | 2/2006 |
| JP | 2006-207994 | A | 8/2006 |
| JP | 3942210 | B2 | 7/2007 |
| JP | 2012-067971 | A | 4/2012 |
| WO | 2006/070918 | A1 | 7/2006 |
| WO | 2016/027811 | A1 | 2/2016 |

OTHER PUBLICATIONS

International Search Report of the International Searching Authority dated Jun. 7, 2016 for the corresponding international application No. PCT/JP2016/058533 (and English translation).

* cited by examiner (a)

(b)

(c)

HEAT EXCHANGER AND AIR CONDITIONER

CROSS REFERENCE TO RELATED APPLICATION

This application is a U.S. national stage application of PCT/JP2016/058533 filed on Mar. 17, 2016, the contents of which are incorporated herein by reference.

TECHNICAL FIELD

The present invention relates to a heat exchanger and an air conditioner including the heat exchanger.

BACKGROUND ART

A conventionally known heat exchanger includes a pair of headers facing each other horizontally in its upper and lower portions, a plurality of flat heat transfer tubes communicatively connected in parallel with the headers at uniform intervals, and corrugated fins provided in a gap between the flat heat transfer tubes to be brought into intimate contact with the tubes. The heat exchanger causes refrigerant that is a heat exchange medium to be distributed in parallel to the plurality of flat heat transfer tubes simultaneously.

When such a heat exchanger is subjected to a heating operation in cold weather as an air conditioner outdoor unit of heat pump type for cooling and heating, frost is formed on the fin and the surface of the heat transfer tube, decreasing a heat exchange efficiency.

Japanese Patent Laying-Open No. 09-280754 (PTD 1) discloses a heat exchanger to take a measure against such frost formation. The heat exchanger includes corrugated fins disposed to project windward from flat heat transfer tubes and includes louvers formed only in its leeward portion.

CITATION LIST

Patent Document

PTD 1: Japanese Patent Laying-Open No. 09-280754

SUMMARY OF INVENTION

Technical Problem

Although the heat exchanger described in PTD 1 includes fins projecting windward of a refrigerant flow paths (flat tubes) and can accordingly prevent or reduce the frost formation on the fins located windward, it suffers from a low defrosting efficiency on the fins. For example, the frost on the fin is melted into water through the defrosting operation, and the water is drained through the fins and the heat transfer tubes. However, the fin includes many regions extending horizontally, allowing the water to easily stay on the fin. In particular, water is drained only through the fin in the portion projecting windward in the fin of the heat exchanger, allowing water to easily stay on the fin, which leads to poor drainage efficiency. This results in a low defrosting efficiency of the heat exchanger.

The present invention has been made to solve the above problem. At an object of the present invention is to provide a heat exchanger capable of reducing frost formation on a fin and having high defrosting efficiency.

Solution to Problem

A heat exchanger according to the present invention includes at least one heat transfer tube which is provided to extend in a first direction and in which refrigerant flows, a fin connected to the at least one heat transfer tube and having a first region and a second region which are located windward of the at least one heat transfer tube in a second direction crossing the first direction, and a first guide member provided to extend in the first direction. The first region and the second region are spaced apart from each other in a third direction crossing the first direction and the second direction. The first guide member is disposed between the first region and the second region in the third direction. Among the at least one heat transfer tube and the first guide member, the first guide member is disposed most windward in the second direction.

An air conditioner according to the present invention includes a heat exchanger according to the present invention and a fan configured to blow a gas to the heat exchanger in the second direction.

Advantageous Effects of Invention

The present invention can provide a heat exchanger with high defrosting efficiency capable of preventing or reducing frost formation on a fin.

BRIEF DESCRIPTION OF DRAWINGS

FIG. 5(*b*) is a graph showing the distribution of the temperature of a surface of the fin shown in (a) during heating operation, and the distribution of the temperature of air passing through on the surface. FIG. 5(*c*) is a graph showing the distribution of the amount of heat exchange between the fin and air on the fin shown in (a) during heating operation.

DESCRIPTION OF EMBODIMENTS

Figure 1:
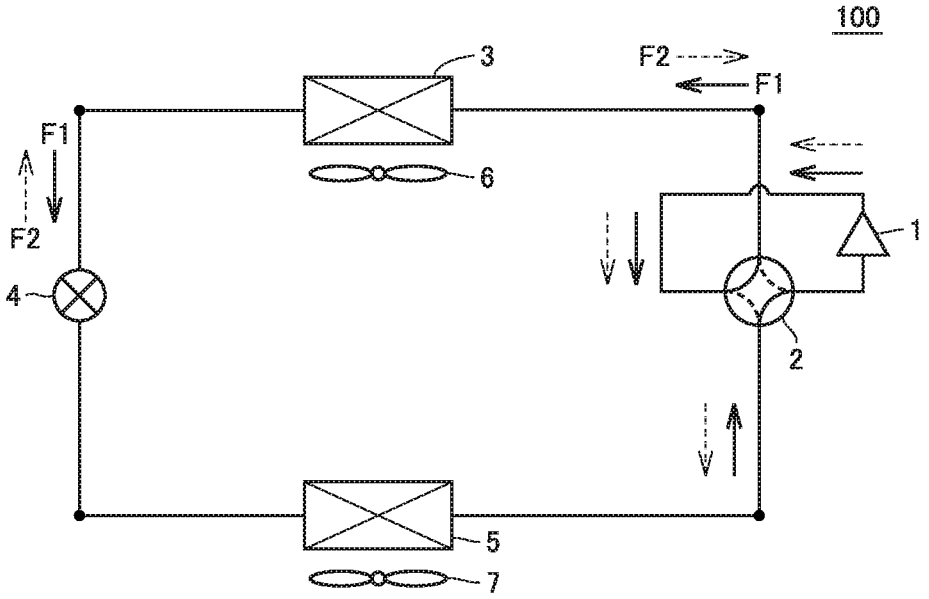
FIG. 1 shows a heat exchanger and an air conditioner according to Embodiment 1.

Embodiments of the present invention will be described below with reference to the drawings, in which the same or corresponding parts will be designated by the same reference numerals, and a description thereof will not be repeated.

Embodiment 1

<Air Conditioner>

An air conditioner 100 according to Embodiment 1 will be described first with reference to FIG. 1. Air conditioner 100 includes a compressor 1, a four-way valve 2, an indoor heat exchanger 3, an expansion valve 4, an outdoor heat exchanger 5, an indoor fan 6, and an outdoor fan 7. Compressor 1, four-way valve 2, indoor heat exchanger 3, expansion valve 4, and outdoor heat exchanger 5 constitute a refrigerant circuit in which refrigerant circulates.

Compressor 1 has an inlet side and an outlet side which are connected to four-way valve 2. Four-way valve 2 is provided in the refrigerant circuit so as to switch a refrigerant flow direction. Air conditioner 100 is provided so as to perform heating operation, cooling operation, and defrosting operation by switching the refrigerant flow direction by four-way valve 2. In FIG. 1, a solid line and an arrow F1 indicate a refrigerant flow path during heating operation, and a broken line and an arrow F2 indicate a refrigerant flow path during cooling operation and defrosting operation. Four-way valve 2 is provided so as to cause the refrigerant (high temperature and high pressure) discharged from compressor 1 to flow out to indoor heat exchanger 3 during heating operation. Four-way valve 2 is provided so as to cause the high-temperature, high-pressure refrigerant discharged from compressor 1 to flow out to outdoor heat exchanger 5 during cooling operation and defrosting operation. Expansion valve 4 expands the refrigerant flowing from indoor heat exchanger 3 to outdoor heat exchanger 5 during heating operation. Expansion valve 4 expands the refrigerant flowing from outdoor heat exchanger 5 to indoor heat exchanger 3 during cooling operation and defrosting operation. Indoor heat exchanger 3 acts as a condenser during heating operation and as an evaporator during cooling operation and defrosting operation. Outdoor heat exchanger 5 acts as an evaporator during heating operation and as a condenser during cooling operation and defrosting operation. Indoor fan 6 is provided so as to blow air to indoor heat exchanger 3. Outdoor fan 7 is provided so as to blow air to outdoor heat exchanger 5 in a second direction B, which will be described below.

<Outdoor Heat Exchanger>

Figure 2:
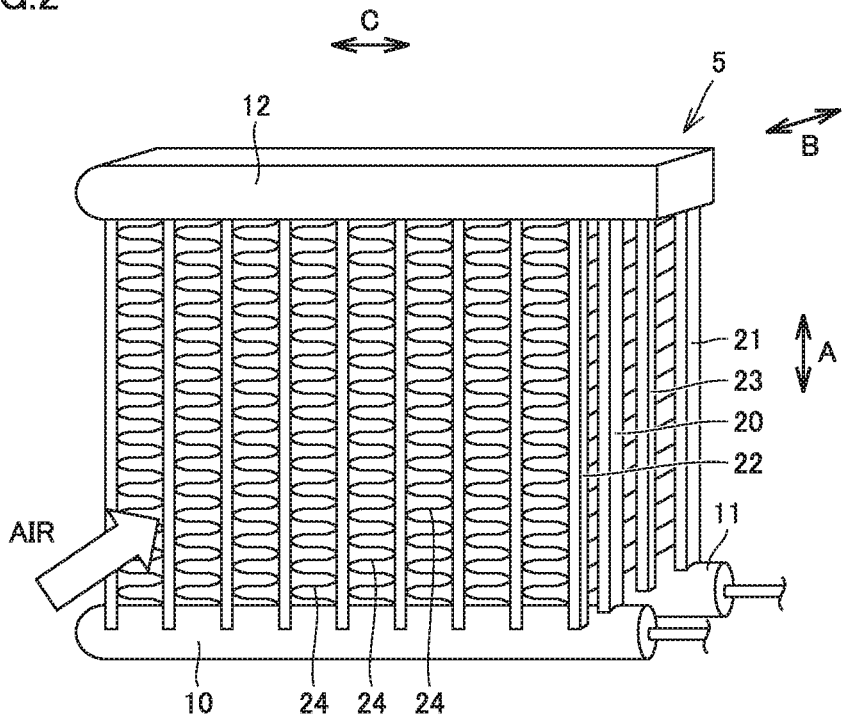
FIG. 2 is a schematic view of the heat exchanger according to Embodiment 1.
Figure 3:
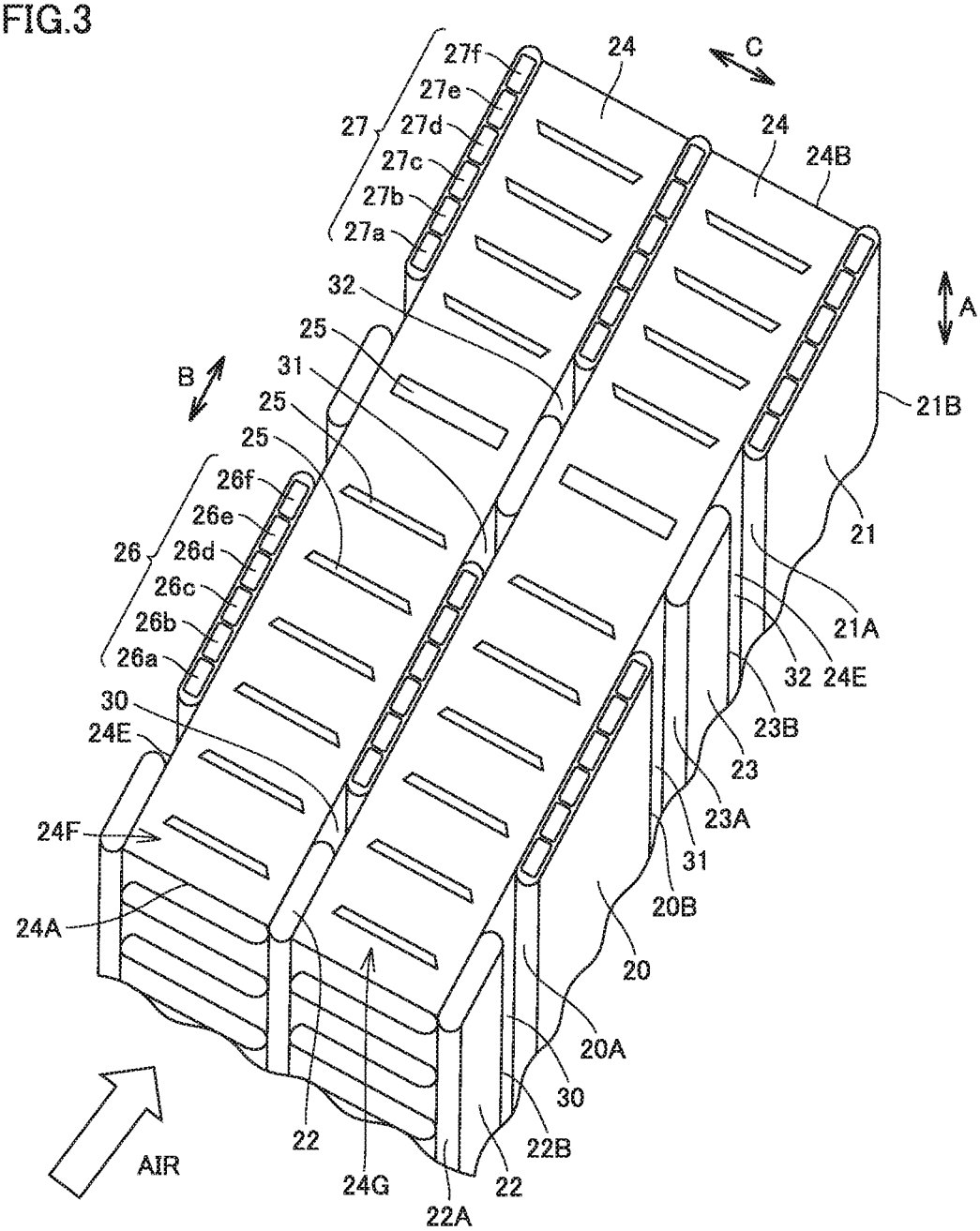
FIG. 3 is a partially enlarged view of the heat exchanger shown in FIG. 2.

Outdoor heat exchanger 5 will now be described with reference to FIGS. 1 to 4. Outdoor heat exchanger 5 performs heat exchange between refrigerant and gas. With reference to FIGS. 2 and 3, outdoor heat exchanger 5 mainly includes a heat transfer tube 20, a heat transfer tube 21, a first guide member 22, a second guide member 23, and a fin 24 (including first and second fin portions 24).

As shown in FIGS. 2 and 3, heat transfer tubes 20 and 21 are, for example, flat heat transfer tubes. Heat transfer tubes 20 and 21 are provided to extend in a first direction A. The refrigerant flows in heat transfer tubes 20 and 21 in first direction A. First direction A may be any direction crossing the horizontal direction, which is the vertical direction, for example.

Heat transfer tube 20 and heat transfer tube 21 are spaced apart from each other in second direction B. Second direction B is a direction crossing first direction A and extends in the flow direction of the gas blown to outdoor heat exchanger 5 by outdoor fan 7. Second direction B is, for example, the horizontal direction. Heat transfer tube 20 is disposed windward of heat transfer tube 21 in second direction B. Heat transfer tubes 20 and 21 are connected to first and second fin portions 24 in a third direction C. Third direction C is a direction crossing first direction A and second direction B. Third direction C is, for example, the horizontal direction and is a direction orthogonal to second direction B.

A plurality of through-holes 26 extending in first direction A are provided in heat transfer tube 20. Through-holes 26 include, for example, six through-holes 26*a*, 26*b*, 26*c*, 26*d*, 26*e*, and 26*f*. A plurality of through-holes 27 extending in first direction A are provided in heat transfer tube 21. Through-holes 27 include, for example, six through-holes 27*a*, 27*b*, 27*c*, 27*d*, 27*e*, and 27*f*. The cross-sections of through-holes 26 and 27 orthogonal to first direction A may have any shape, which is a rectangular shape, for example. Through-holes 26 are connected to a first distributor 10, which will be described below. This allows the refrigerant to flow in through-holes 26 of heat transfer tube 20. Through-holes 27 are connected to a second distributor 11, which will be described below. This allows the refrigerant to flow in through-holes 27 of heat transfer tube 21.

First guide member 22 and second guide member 23 are provided to extend in first direction A. The refrigerant flowing in the refrigerant circuit of air conditioner 100 does not flow in first guide member 22 and second guide member 23. That is to say, first guide member 22 and second guide member 23 do not constitute the refrigerant circuit of air conditioner 100. First guide member 22 and second guide member 23 are so-called solid members in which no through-holes are provided, unlike heat transfer tubes 20 and 21. Through-holes extending in first direction A may be provided inside first guide member 22 and second guide member 23. It suffices that in this case, the through-holes provided in first guide member 22 and second guide member 23 are not connected to the refrigerant circuit of air conditioner 100.

The material for first guide member 22 and second guide member 23 is, for example, copper (Cu) or aluminum (Al). The material for first guide member 22 and second guide member 23 may be identical to or different from the material for heat transfer tubes 20 and 21. The material for first guide member 22 and second guide member 23 may be, for example, resin such as hard resins such as polypropylene and a composite material including polypropylene.

First guide member 22 and second guide member 23 are spaced apart from each other in second direction B. First guide member 22 is disposed windward of second guide member 23 in second direction B. First guide member 22 and second guide member 23 are connected to first and second fin portions 24 in third direction C. It suffices that first guide member 22 and second guide member 23 are connected to first and second fin portions 24 by any method, which are fixed to first and second fin portions 24 by, for example, brazing.

First guide member 22 is disposed between and connected to a first region 24F of first fin portion 24, which will be described below, and a second region 24G of second fin portion 24, which will be described below. First guide member 22 has a first surface that is not connected to first and second fin portions 24. Second guide member 23 has a second surface that is not connected to first and second fin portions 24. The first surface and the second surface are provided to extend in first direction A. The lower edges of the first surface and the second surface in first direction A are provided so as to efficiently drain the water that has passed through on the first surface and the second surface to reach the lower edges. The lower edges of the first surface and the second surface are connected to, for example, a drain member (not shown) that can drain water out of outdoor heat exchanger 5. The lower edges of the first surface and the second surface may be spaced apart from, for example, the drain member such as a drain pan above this drain member.

Figure 5:
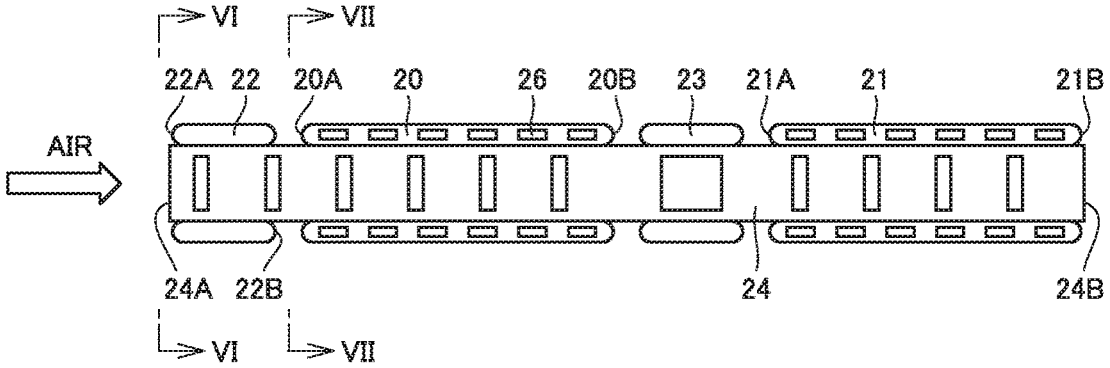
FIG. 5(*a*) is a plan view of one fin and two heat transfer tubes adjacent to each other with the one fin therebetween, namely, a first heat transfer tube and a second heat transfer tube, in the heat exchanger shown in FIG. 3.
Figure 5:
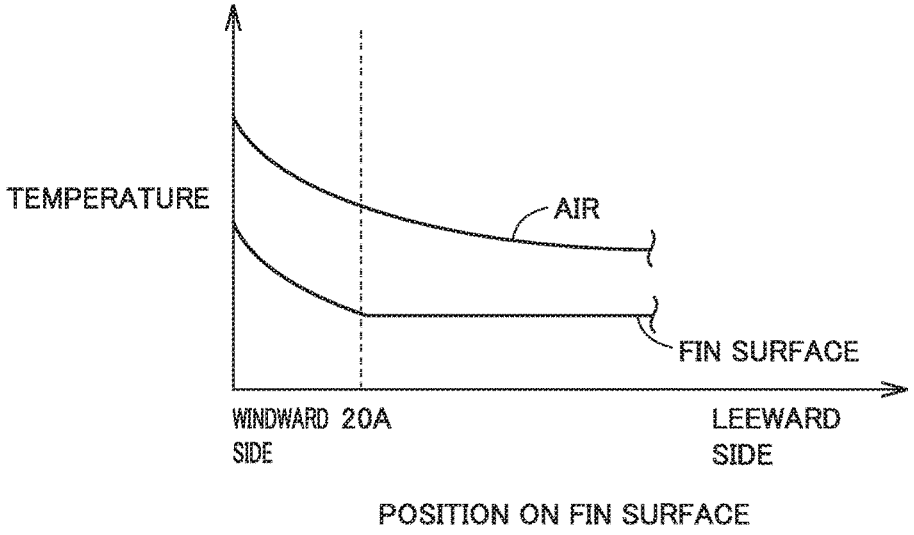
Figure 5:
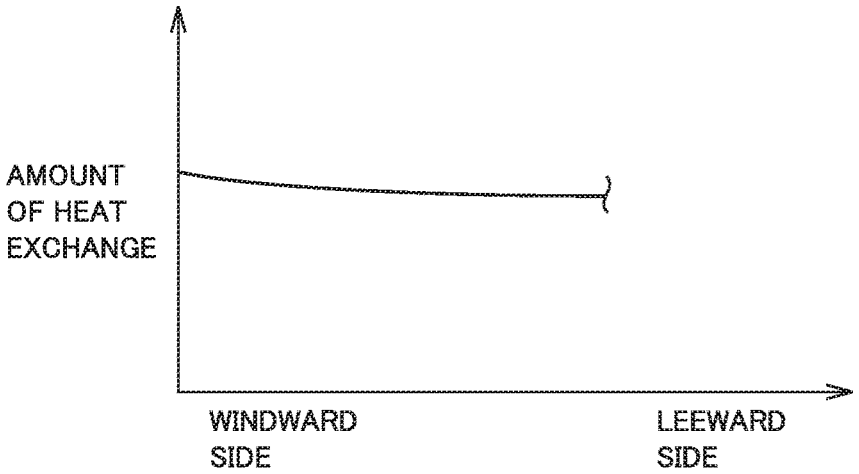

With reference to FIGS. 3, 5(*a*), and 8(*a*), the cross-sections of first guide member 22 and second guide member 23 which are perpendicular to first direction A have, for example, an approximately oval shape. First guide member 22 and second guide member 23 are disposed such that, for example, the long axes thereof extend in second direction B.

Among heat transfer tubes 20 and 21, first guide member 22, and second guide member 23, first guide member 22 is disposed most windward in second direction B. First guide member 22, heat transfer tube 20, second guide member 23, and heat transfer tube 21 are disposed in order from windward to leeward in second direction B. First guide member 22 and heat transfer tube 20 are spaced apart from each other in the second direction. Heat transfer tube 20 and second guide member 23 are spaced apart from each other in the second direction. Second guide member 23 and heat transfer tube 21 are spaced apart from each other in the second direction.

First guide member 22 has a first end 22A located windward and a second end 229 located leeward. The surfaces of first end 22A and second end 22B are provided to extend in first direction A and are not connected to first and second fin portions 24. The first surface is formed of the surfaces of first end 22A and second end 22B. Heat transfer tube 20 has a third end 20A located windward and a fourth end 20B located leeward. Second guide member 23 has a fifth end 23A located windward and a sixth end 23B located leeward. The surfaces of fifth end 23A and sixth end 23B are provided to extend in first direction A and are not connected to first and second fin portions 24. The second surface is formed of the surfaces of fifth end 23A and sixth end 23B. Heat transfer tube 21 has a seventh end 21A located windward and an eighth end 21B located leeward. First and second fin portions 24 have a ninth end 24A located windward and a tenth end 24B located leeward.

A first space 30 is provided between second end 22B of first guide member 22 which is located leeward and third end 20A of heat transfer tube 20 which is located windward. That is to say, first space 30 faces a part of the first surface of first guide member 22. A second space 31 is provided between fourth end 209 of heat transfer tube 20 which is located leeward and fifth end 23A of second guide member 23 which is located windward. That is to say, second space 31 faces a part of the second surface of second guide member 23. A third space 32 is provided between sixth end 23B of second guide member 23 which is located leeward and seventh end 21A of heat transfer tube 21 which is located windward. That is to say, third space 32 faces a part of the second surface of second guide member 23. Spaces 30, 31, and 32 face lateral ends 24E of first and second fin portions 24 in third direction C.

First end 22A of first guide member 22 is provided to be continuous with, for example, ninth ends 24A of first and second fin portions 24 in third direction C. Eighth end 21B of heat transfer tube 21 is provided to be continuous with, for example, tenth ends 24B of first and second fin portions 24 in third direction C.

Heat transfer tubes 20 and 21, first guide member 22, and second guide member 23 have the same width in, for example, third direction C. The widths of first guide member 22 and second guide member 23 in second direction B are smaller than, for example, the widths of heat transfer tubes 20 and 21 in second direction B. In other words, an area $S_1$ of the cross-section of first guide member 22 which is perpendicular to first direction A and an area $S_2$ of the cross-section of second guide member 23 which is perpendicular to first direction A are smaller than areas $S_3$ and $S_4$ of the cross-sections of heat transfer tubes 20 and 21 perpendicular to first direction A. Areas $S_3$ and $S_4$ also include the areas inside through-holes 26 and 27. The width of first guide member 22 in second direction B is smaller than the distance between third end 20A of heat transfer tube 20 and each of ninth ends 24A of first and second fin portions 24 in second direction B. Although the distance between third end 20A of heat transfer tube 20 and each of ninth ends 24A of first and second tin portions 24 in second direction B may have any value as long as the frost on ninth end 24A can be melted by the heat of the refrigerant flowing in through-hole 26 of heat transfer tube 20 during defrosting operation, this distance preferably has the smallest possible value.

Fin 24 includes first fin portion 24 and second fin portion 24 disposed with heat transfer tubes 20 and 21 therebetween in third direction C. First and second fin portions 24 are configured separately. First and second fin portions 24 have, for example, a similar configuration. First and second fin portions 24 are separated from each other in third direction C. First and second fin portions 24 are formed as corrugated fins formed of, for example, a thin film made of metal or the like shaped in a wave form. First fin portion 24 has first region 24F located windward of heat transfer tube 20 located most windward in second direction B. Second fin portion 24 has second region 24G located windward of heat transfer tube 20 located most windward in second direction B. First region 24F and second region 24G are spaced apart from each other in third direction C. As described above, first guide member 22 is connected to first region 24F and second region 24G.

First and second fin portions 24 are provided with, for example, a plurality of louvers 25. Louvers 25 are provided to extend in third direction C and are spaced apart from each other in second direction B. Some of louvers 25 are provided in a portion of fin 24 which is located between adjacent first guide members 22 in third direction C, a portion of fin 24 which is located between adjacent second guide members 23 in third direction C, and a portion of fin 24 which is located between adjacent heat transfer tubes 20 and 21 in third direction C.

Figure 4:
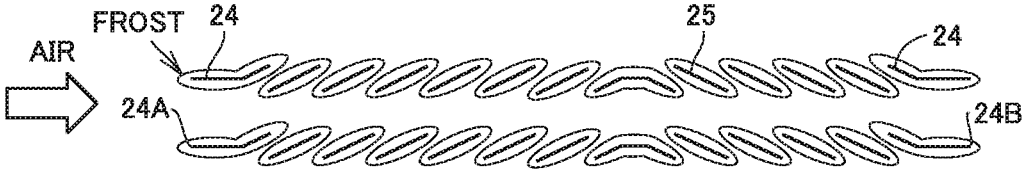
FIG. 4 is a sectional view for illustrating fins of the heat exchanger shown in FIG. 3.

With reference to FIGS. 3 and 4, louvers 25 are provided such that louvers 25 located on the ninth end 24A side with respect to second guide member 23 and louvers 25 located on the tenth end 24B side with respect to second guide member 23 have line symmetry.

For example, a plurality of heat transfer tubes 20, a plurality of heat transfer tubes 21, a plurality of first guide members 22, and a plurality of second guide members 23 are provided. Heat transfer tubes 20 are spaced apart from each other in third direction C. Heat transfer tubes 21 are spaced apart from each other with first or second fin portion 24 therebetween in third direction C. First guide members 22 are spaced apart from each other with first or second fin portion 24 therebetween in third direction C. Second guide members 23 are spaced apart from each other with first or second fin portion 24 therebetween in third direction C. Fin 24 may further include a plurality of fin portions spaced apart from each other in third direction C, in addition to the first and second fin portions. The fin portions are spaced apart from each other with one heat transfer tube 20, one heat transfer tube 21, one first guide member 22, and one second guide member 23 therebetween in third direction C. In this case, a plurality of spaces 30, a plurality of spaces 31, and a plurality of spaces 32 are provided in third direction C.

It suffices that outdoor heat exchanger 5 has any configuration as long as it has the above configuration. For example, outdoor heat exchanger 5 further includes first distributor 10, second distributor 11, and a folded header 12 as shown in FIG. 2.

The respective lower ends of heat transfer tubes 20 in first direction A are connected to first distributor 10. First distributor 10 is provided so as to distribute the refrigerant to heat transfer tubes 20. The respective lower ends of heat transfer tubes 21 in first direction A are connected to second distributor 11. Second distributor 11 is connected to the respective lower ends of heat transfer tubes 21 in first direction A. Second distributor 11 is provided so as to distribute the refrigerant to heat transfer tubes 21. First distributor 10 is disposed windward of second distributor 11. First distributor 10 is connected to expansion valve 4 through, for example, a refrigerant pipe. Second distributor 11 is connected to four-way valve 2 through, for example, a refrigerant pipe. Folded header 12 is connected to the respective upper ends of heat transfer tube 20 and heat transfer tube 21 in first direction A.

The respective lower ends and the respective upper ends of first guide members 22 in first direction A are not connected to, for example, all of first distributor 10, second distributor 11, and folded header 12. The respective lower ends and the respective upper ends of second guide members 23 in first direction A are not connected to, for example, all of first distributor 10, second distributor 11, and folded header 12. The lower edge of the first surface may be provided to be in contact with the outer surface of first distributor 10, which will be described below. The lower edge of the second surface may be provided to be in contact with the outer surface of second distributor 11, which will be described below.

<Operation of Refrigeration Cycle Apparatus>

The operations of air conditioner 100 and outdoor heat exchanger 5 will now be described with reference to FIG. 1. Air conditioner 100 forms a refrigerant flow path indicated by the solid line and arrow F1 in FIG. 1 during heating operation. The refrigerant in a gas-liquid two-phase state, which has been condensed by indoor heat exchanger 3 and expanded by expansion valve 4, is supplied to first distributor 10 of outdoor heat exchanger 5. Outdoor heat exchanger 5 is provided with a refrigerant flow path from first distributor 10 through heat transfer tube 20, folded header 12, and heat transfer tube 21 to second distributor 11.

With reference to FIGS. 5(*a*) and (*b*), during heating operation, a partial region of fin 24 located leeward of third end 20A of heat transfer tube 20 is cooled by refrigerant flowing in through-hole 26 of heat transfer tube 20 to a temperature approximately equal to the temperature of the refrigerant. The surface temperature of fin 24 thus exhibits a uniform temperature distribution on the partial region.

In contrast, the other region of fin 24 which is sandwiched between first guide members 22 adjacent to each other in third direction C and is located windward of the partial region, that is, the region of fin 24 located (projecting) windward of heat transfer tube 20 is distant from heat transfer tube 20 through which the refrigerant flows, compared with the partial region. The surface temperature of fin 24 thus exhibits a temperature distribution according to the distance from heat transfer tube 20 in the other region. That is to say, the surface temperature of fin 24 exhibits a temperature distribution in which temperature is highest at ninth end 24A of fin 24 which is located most distant from third end 20A of heat transfer tube 20 and gradually decreases as closer to the position at which the surface overlaps third end 20A of heat transfer tube 20 in third direction C.

With reference to FIG. 5(*b*), during heating operation, the temperature of the air flowing on the surface of fin 24 exhibiting the above temperature distribution exhibits a temperature distribution in which the temperature is higher than the surface temperature of fin 24 and gradually decreases from the ninth end 24A side (windward side) of fin 24 to the tenth end 24B side (leeward side) of fin 24. The vertical axis of FIG. 5(*b*) represents a temperature of the surface of fin 24 or air flowing on the surface, and the horizontal axis of FIG. 5(*b*) represents a position on the surface of fin 24 (a distance from ninth end 24A of fin 24 in second direction B). The vertical axis of FIG. 5(*c*) represents an amount of heat exchange between refrigerant and air through fin 24, and the horizontal axis of FIG. 5(*c*) represents a position on the surface of fin 24 (a distance from ninth end 24A of fin 24 in second direction B).

The surface temperature of fin 24 and the temperature of the air flowing on the surface of fin 24 exhibit the temperature distributions as shown in FIG. 5(*b*), and accordingly, the amount of heat exchange between the refrigerant and the outdoor air through fin 24 exhibits an almost uniform distribution from ninth end 24A to tenth end 24B of firm 24, as shown in FIG. 5(*c*). As shown in FIG. 4, thus, the frost formation amount on fin 24 can be made almost uniform from ninth end 24A of fin 24 to tenth end 24B of fin 24 during heating operation.

Air conditioner 100 forms a refrigerant flow path indicated by the broken line and arrow F2 shown in FIG. 1 during cooling operation and defrosting operation. The high-temperature, high-pressure refrigerant in a gas single-phase state, which has been evaporated by indoor heat exchanger 3 and compressed by compressor 1, is supplied to second distributor 11 of outdoor heat exchanger 5. Outdoor heat exchanger 5 is provided with a refrigerant flow path from second distributor 11 through heat transfer tube 21, folded header 12, and heat transfer tube 20 to first distributor 10. Since a frost formation amount on the fin 24 during heating operation is made uniform in second direction B during defrosting operation, the frost on fin 24 is melted efficiently irrespective of its position in second direction B.

Figure 6:
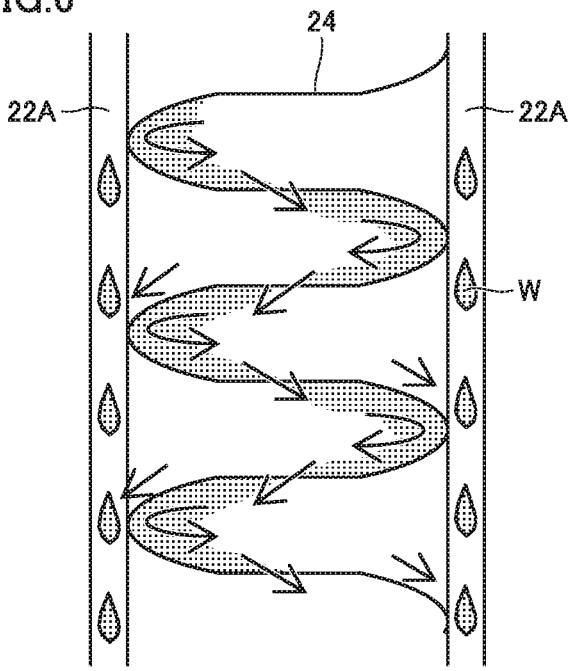
FIG. 6 is an end view taken along a line segment VI-VI of FIG. 5(*a*) during defrosting operation.
Figure 7:
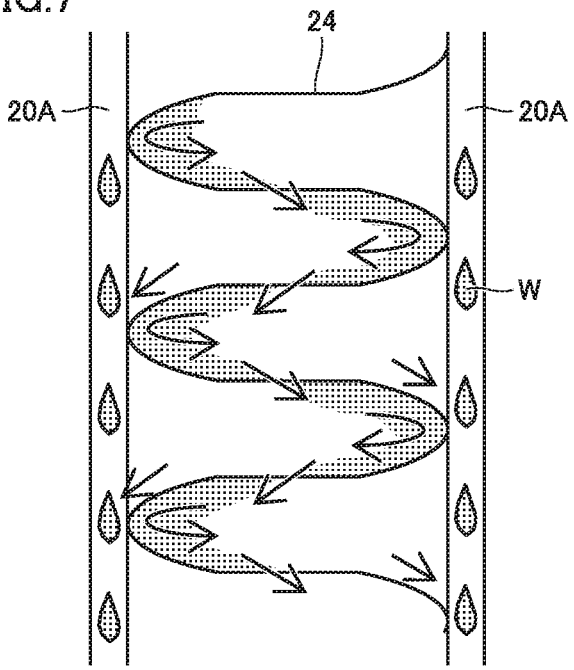
FIG. 7 is an end view taken along a line segment VII-VII of FIG. 5(*a*) during defrosting operation.

With reference to FIGS. 3, 6, and 7, the frost melted during defrosting operation described above turns into water W and is drained, and is subsequently removed from outdoor heat exchanger 5. Outdoor heat exchanger 5 has three drain flow paths for the frost that has been removed. A first drain flow path is a drain flow path passing through the surface of fin 24 and louver 25 and running from above to below vertically. A second drain flow path is a drain flow path passing through third end 20A and fourth end 20B of heat transfer tube 20 and seventh end 21A and eighth end 21B of heat transfer tube 21 and running from above to below vertically. A third drain flow path is a drain flow path passing through first end 22A and second end 22B of first guide member 22 and fifth end 23A and sixth end 23B of second guide member 23 and running from above to below vertically.

Outdoor heat exchanger 5 thus has a drainage efficiency higher than that of an outdoor heat exchanger having no first guide member 22, that is, an outdoor heat exchanger having no third drain flow path passing through first guide member 22 and having only the first drain flow path and the second drain flow path. In particular, outdoor heat exchanger 5 has a high drain efficiently in a region of fin 24 which is located windward of heat transfer tube 20. This allows outdoor heat exchanger 5 to reduce a time for defrosting operation more than the above outdoor heat exchanger. In addition, outdoor heat exchanger 5 prevents water from staying on fin 24 and also prevents the water which has stayed on fin 24 even after defrosting operation from forming frost again during heating operation, and accordingly has high heat exchange efficiency during heating operation.

<Function and Effect>

Outdoor heat exchanger 5 according to Embodiment 1 includes heat transfer tubes 20 and 21, first guide member 22, and fin 24. Heat transfer tube 20 is provided to extend in first direction A, in which refrigerant flows. Fin 24 is connected to heat transfer tubes 20 and 21. Fin 24 has first region 24F and second region 24G located windward of heat transfer tube 20 in second direction B. First region 22F and second region 24G are spaced apart from each other in third direction C. First guide member 22 is disposed between first region 24F and second region 24G in third direction C. Of heat transfer tubes 20 and 21, first guide member 22 is disposed most windward. First guide member 22 has first end 22A and second end 22B as a first surface which extends in first direction A and is not connected to fin 24. Refrigerant does not flow in first guide member 22.

In outdoor heat exchanger 5, fin 24 has first region 24F and second region 24G located windward of heat transfer tube 20 in second direction B. This allows outdoor heat exchanger 5 to prevent or reduce frost formation on first region 24F and second region 24G of fin 24 during heating operation in which outdoor heat exchanger 5 acts as an evaporator, thus making the frost formation amount on fin 24 uniform in third direction C. Thus, outdoor heat exchanger 5 can efficiently melt the frost on fin 24 during defrosting operation. In addition, outdoor heat exchanger 5 includes first guide member 22 connected to first region 24F and second region 24G of fin 24, and thus can efficiently drain the water, generated on first region 24F and second region 24G during defrosting operation, downward in first direction A through first end 22A and second end 22B of first guide member 22. That is to say, outdoor heat exchanger 5 prevents or reduces frost formation on fin 24 and has high defrosting efficiency.

In outdoor heat exchanger 5, the first surface of first guide member 22 has a surface of second end 22B of first guide member 22 which is located leeward in second direction B. This allows outdoor heat exchanger 5 to have a drainage efficiency higher than that of an outdoor heat exchanger in which the first surface has only the surface of first end 22A of first guide member 22 which is located windward.

In outdoor heat exchanger 5, fin 24 includes first fin portion 24 and second fin portion 24 disposed with heat transfer tubes 20 and 21 therebetween in third direction C. First region 24F is formed on first fin portion 24, and second region 24G is formed on second tin portion 24. This allows outdoor heat exchanger 5 to efficiently drain the water, generated on first region 24F and second region 24G of the corrugated fin during defrosting operation, downward in first direction A through first end 22A and second end 22B of first guide member 22 even when, for example, first and second fin portions 24 are formed of corrugated fins or the like.

Outdoor heat exchanger 5 includes heat transfer tubes 20 and 21 spaced apart from each other in second direction B, and at least one second guide member 23 provided to extend in first direction A and spaced apart from two heat transfer tubes 20 and 21 adjacent to each other in second direction B among heat transfer tubes 20 and 21 between the two adjacent heat transfer tubes 20 and 21. Second guide member 23 has a second surface which extends in first direction A and is not connected to fin 24. Alternatively, three or more heat transfer tubes may be spaced apart from each other in second direction B. In this case, a second guide member is preferably disposed between two heat transfer tubes adjacent to each other in second direction B. Consequently, the region of fin 24 which is located between the two heat transfer tubes adjacent to each other in second direction B and is not connected to heat transfer tubes is connected with second guide member 23 having the second surface. Outdoor heat exchanger 5 including second guide member 23 can thus increase the efficiency of draining water from the relevant region on fin 24.

Air conditioner 100 according to Embodiment 1 includes outdoor heat exchanger 5 as described above, outdoor fan 7 that blows gas to outdoor heat exchanger 5 in second direction B, and four-way valve 2 capable of switching the flow direction of the refrigerant flowing through heat transfer tubes 20 and 21 of outdoor heat exchanger 5. Air conditioner 100 can thus have high efficiency during heating operation and defrosting operation.

Figure 8:
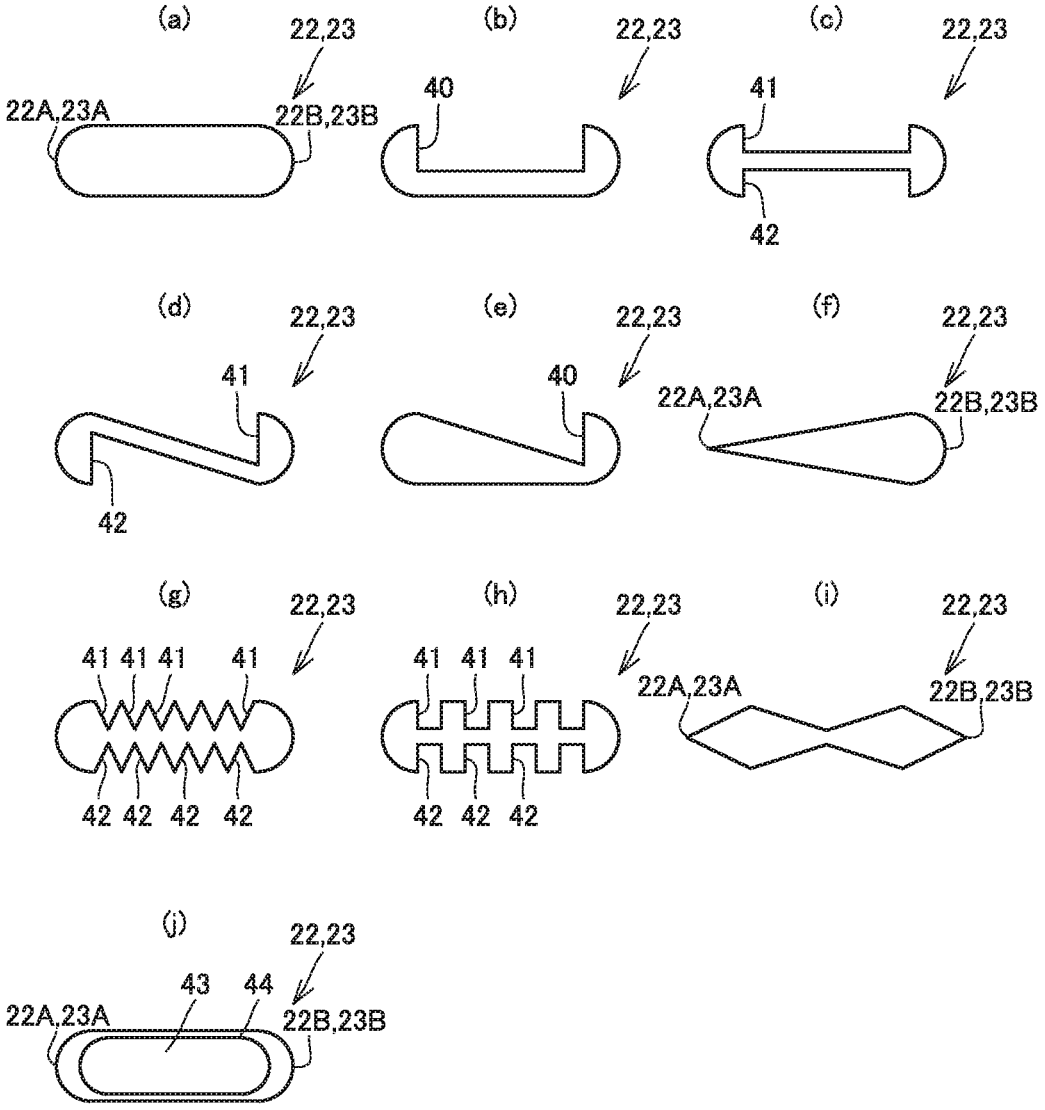
FIG. 8 is a sectional view showing an example configuration of a first guide member in Embodiment 1.

First guide member 22 and second guide member 23 may have any configuration as long as they have the first surface and the second surface. FIGS. 8(*b*) to (*i*) show the examples of the sectional shapes of first guide member 22 and second guide member 23 perpendicular to first direction A, other than the example of FIG. 8(*a*).

As shown in FIGS. 8(*b*) to (*e*), (*g*), and (*h*), first guide member 22 may have a sectional shape in which an indentation 40, 41, 42 is provided between first end 22A and second end 22B in the longitudinal direction of first guide member 22 shown in FIG. 8(*a*). Indentation 40, 41, 42 is provided to extend in first direction A (see FIGS. 2 and 3). In first guide member 22 described above, the inner circumferential surface of indentation 40, 41, 42 can also be a surface which is provided to extend in first direction A and is not connected to fin 24. First guide members 22 shown in FIGS. 8(*b*) to (*e*), (*g*), and (*h*) accordingly have a large surface area of the first surface of first guide member 22 and a high efficiency of draining the water through the first surface, compared with first guide member 22 shown in FIG. 8(*a*).

As shown in FIGS. 8(*b*) and (*e*), first guide member 22 may be provided with indentation 40 only on one outer surface side extending in its longitudinal direction. As shown in FIGS. 8(*c*) and (*d*), first guide member 22 may be provided with indentation 41 on one outer surface side extending its longitudinal direction as well as indentation 42 on the other outer surface side. As shown in FIGS. 8(*g*) and (*h*), at least one of indentation 41 and indentation 42 may be plural. The cross-sections of indentation 40, 41, 42 may have any shape, which may be, for example, a rectangular shape or triangular shape. Indentation 41 and indentation 42 may be provided to have line symmetry with the center line of first guide member 22 extending longitudinally therebetween as shown in FIG. 8(*c*), or may be provided to have point symmetry about the center of the cross-section of first guide member 22 as shown in FIG. 8(*d*).

As shown in FIGS. 8(*f*) and (*i*), the cross-section of first guide member 22 perpendicular to first direction A may be provided such that the portion thereof located leeward of first end 22A, that is, the portion thereof located at the side closer to second end 22B with respect to first end 22A has a great width in third direction C compared with first end 22A located windward. First guide member 22 as described above can lessen the colliding resistance of a gas generated by the collision of the gas blown from outdoor fan 7 to outdoor heat exchanger 5 with first guide member 22. First end 22A is provided, for example, linearly to extend in first direction A. As shown in FIG. 8(*f*), second end 22B may be provided to have the greatest width in first guide member 22. As shown in FIG. 8(*i*), second end 22B is also provided linearly to extend in first direction A similarly to first end 22A, and portions wider than first end 22A and second end 22B may be provided at the portions located between first end 22A and second end 22B. Alternatively, as shown in FIG. 8(*i*), first guide member 22 may be provided to be in line contact with lateral end 24E of fin 24 (see FIG. 3). In first guide member 22 shown in FIG. 8(*i*), the entire surface of the portion other than the widest portion in third direction C (see FIG. 3) can form the first surface which extends in first direction A and is not connected to fin 24.

Although the example configurations of first guide member 22 have been described with reference to FIGS. 8(*h*) to (*i*), second guide member 23 can have a similar configuration.

With reference to FIG. 8(*j*), first guide member 22 and second guide member 23 may be formed of a base material 43 and a coating film 44 covering base material 43. In this case, the material for coating film 44 is, for example, a resin such as amide compound, vinyl alcohol, epoxy resin, or acrylic resin which is typically highly hydrophilic, and is preferably more hydrophilic than the material for the surface of fin 24. In contrast, the material for base material 43 may be any appropriate material. Herein, the state in which an angle of contact between water and the surface of first guide member 22 is 0° or more and less than 90° is referred to as a highly hydrophilic state.

First guide member 22 and second guide member 23 may be provided such that their lengths in the cross-sections of the first surface and the second surface which are perpendicular to first direction A increase toward downward in first direction A. Such a configuration widens the first surface of first guide member 22 and the second surface of second guide member 23 toward downward in first direction A. Since the water melted from the portion of fin 24 located above lower portions of the first surface and the second surface flows in the lower portions, the flow rate of the water flowing on the first surface and the second surface increases toward downward. The drain efficiency owing to the first surface and the second surface can be increased further when the first surface of first guide member 22 and the second surface of second guide member 23 are wider toward downward in first direction A.

Figure 9:
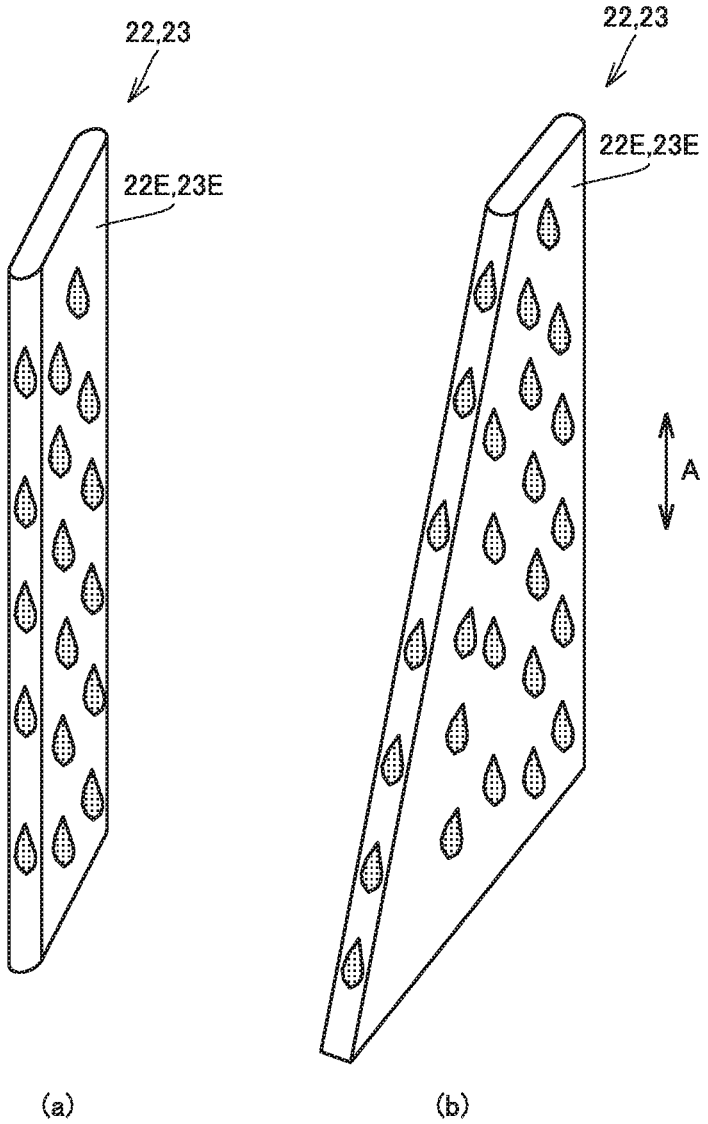
FIG. 9 is a schematic view of an example configuration of the first guide member in Embodiment 1.

It suffices that first guide member 22 and second guide member 23 are adjacent to fin 24 in outdoor heat exchanger 5. Herein, the state in which first guide member 22 and second guide member 23 are adjacent to fin 24 refers to the state in which first guide member 22 and second guide member 23 are connected to fin 24 as described above or the state in which first guide member 22 and second guide member 23 are spaced apart from fin 24 at a minute interval therebetween and are not connected to fin 24. First guide member 22 and second guide member 23 may be spaced apart from lateral end 24E of fin 24 in third direction C at such an interval as to allow the water on lateral end 24E to contact first guide member 22 and second guide member 23. In this case, first guide member 22 and second guide member 23 may be positioned with respect to the component other than fin 24 in outdoor heat exchanger 5. Also with such a configuration, the water that has reached lateral end 24E in fin 24 is efficiently drained by first guide member 22 and second guide member 23. An outdoor heat exchanger including such first guide member 22 can achieve effects similar to those of outdoor heat exchanger 5 according to Embodiment 1. In this case, as shown in FIG. 9(*a*), the first surface has a surface of lateral end 22E of first guide member 22 in third direction C. The second surface has a surface of lateral end 23E of second guide member 23 in third direction C. Alternatively, as shown in FIG. 9(*b*), first guide member 22 may be provided such that the area of a cross-section perpendicular to first direction A increases toward downward in first direction A. In this case, the width of first guide member 22 in third direction C may be provided to be uniform in first direction A, and the width of first guide member 22 in second direction B may be provided to increase toward downward in first direction A. Similarly, second guide member 23 may be provided such that the area of a cross-section perpendicular to first direction A increases toward downward in first direction A. Also with such a configuration, the first surface of first guide member 22 and the second surface of second guide member 23 can be widened toward downward in first direction A, which increases the drainage efficiency by the first surface and the second surface.

First guide member 22 and second guide member 23 may be fixed by press Fitting to outdoor heat exchanger 5 to which heat transfer tubes 20 and 21 and fin 24 are fixed by brazing.

Embodiment 2

Figure 10:
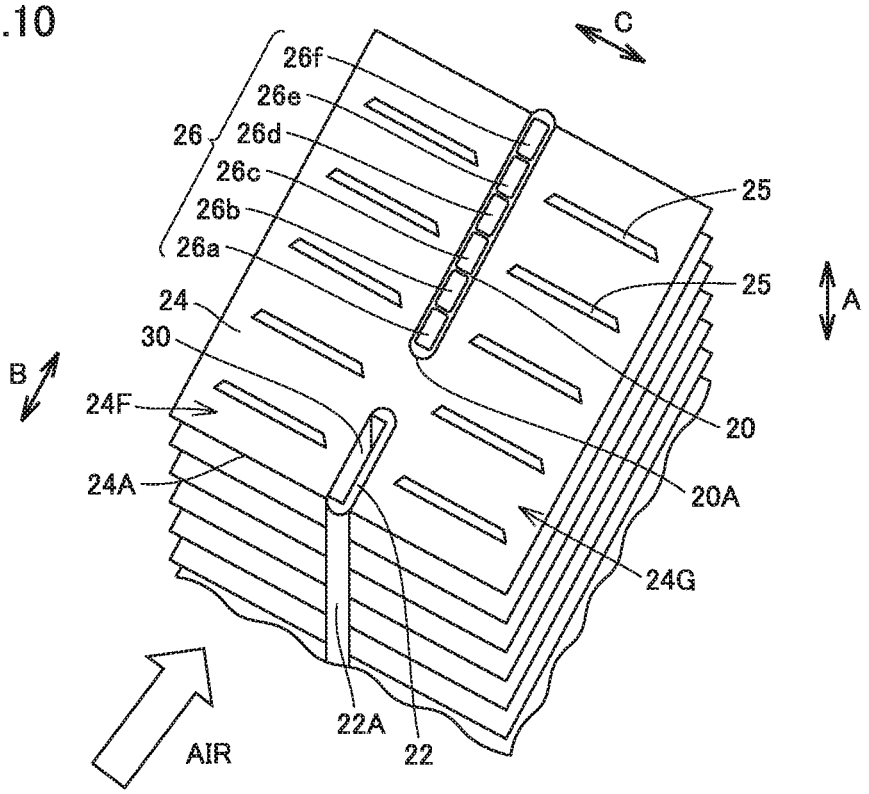
FIG. 10 is a partially enlarged view of a heat exchanger according to Embodiment 2.
Figure 11:
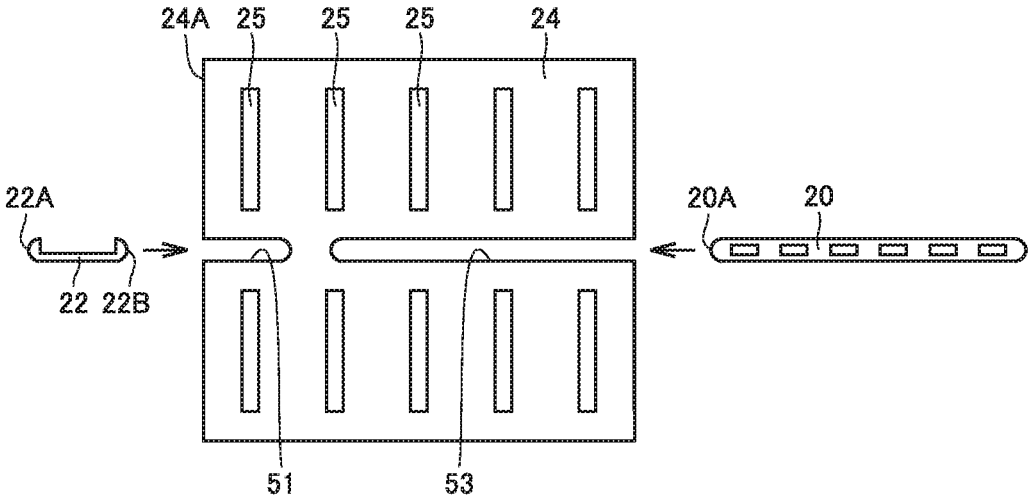
FIG. 11 is a partially enlarged view showing a relationship in which a heat transfer tube and a first guide member are connected to a fin in the heat exchanger according to Embodiment 2.

A heat exchanger according to Embodiment 2 will now be described with reference to FIGS. 10 and 11. The heat exchanger according to Embodiment 2 basically has a configuration similar to that of the heat exchanger according to Embodiment 1 but differs therefrom in that fin 24 is provided with a first cut-away portion 51 capable of receiving first guide member 22 and that the first surface of first guide member 22 is disposed in first cut-away portion 51.

Fin 24 is, for example, a flat fin. A plurality of fins 24 are layered in first direction A. Fins 24 have, for example, the same configuration. First cut-away portion 51 is provided in each of fins 24 layered in first direction A. First cut-away portions 51 have, for example, the same configuration. First cut-away portions 51 are provided to overlap one another in, for example, first direction A.

First cut-away portion 51 faces ninth end 24A of fin 24 and is provided to extend in second direction B. It suffices that first cut-away portion 51 has any configuration as long as it can receive first guide member 22. The width of first cut-away portion 51 in second direction B is equal to, for example, the width of first guide member 22 in second direction B. The width of first cut-away portion 51 in third direction C is equal to, for example, the width of first guide member 22 in third direction C. In this case, first region 24F and second region 24G located windward of heat transfer tube 20 in second direction B are disposed with first cut-away portion 51 therebetween in third direction C.

Second end 22B of first guide member 22 is fitted with, for example, the end of first cut-away portion 51 which is located leeward without any gap. First end 22A of first guide member 22 is provided to be continuous with, for example, ninth end 24A of fin 24. First end 22A may project windward of, for example, ninth end 24A. First guide member 22 is provided with indentation 40 as shown in, for example, FIG. 8(*b*). In this case, the inner circumferential surface of indentation 40 of first guide member 22 is provided to extend in first direction A and is not connected to fin 24. In outdoor heat exchanger 5 according to Embodiment 2, thus, the first surface has the surface of first end 22A and the inner circumferential surface of indentation 40.

Each of fins 24 may be provided with a third cut-away portion 53 capable of receiving heat transfer tube 20. Third cut-away portion 53 faces tenth end 24B of fin 24 and is provided to extend in second direction B. It suffices that third cut-away portion 53 has any configuration as long as it can receive heat transfer tube 20. The width of third cut-away portion 53 in second direction B is equal to, for example, the width of heat transfer tube 20 in second direction B. The width of third cut-away portion 53 in third direction C is equal to, for example, the width of heat transfer tube 20 in third direction C.

Third end 20A of heat transfer tube 20 is fitted with, for example, the end of third cut-away portion 53 which is located windward without any gap. Fourth end 20B of heat transfer tube 20 is provided to be continuous with, for example, tenth end 24B of fin 24. Fourth end 20B may project leeward of, for example, tenth end 24B.

First cut-away portion 51 and third cut-away portion 53 are spaced apart from each other in second direction 13. The end of first cut-away portion 51 which is located leeward is located windward of the end of third cut-away portion 53 which is located windward. From a different perspective, fin 24 includes first fin portion 24 and second fin portion 24 formed with first cut-away portion 51 and third cut-away portion 53 therebetween in third direction C. First and second tin portions 24 are configured integrally. That is to say, fin 24 has a portion located between first cut-away portion 51 and third cut-away portion 53 in second direction B, and first fin portion 24 and second fin portion 24 are connected to each other with this portion therebetween. First guide member 22 is disposed between first region 24F formed on first fin portion 24 and second region 24G formed on second fin portion 24.

First guide member 22 and fin 24 can be positioned with respect to each other by, for example, first guide member 22 inserted into first cut-away portion 51. Heat transfer tube 20 and fin 24 can be positioned with respect to each other by, for example, heat transfer tube 20 inserted into third cut-away portion 53.

Also with such a configuration, fin 24 has first region 24F and second region 24G located windward of heat transfer tube 20 in second direction B, and the frost formation on first region 24F and second region 24G of fin 24 can accordingly be prevented or reduced during heating operation in which outdoor heat exchanger 5 serves as an evaporator, resulting in uniform frost formation amount on fin 24 in third direction C. This allows outdoor heat exchanger 5 to efficiently melt the frost on fin 24 during defrosting operation. Further, since outdoor heat exchanger 5 includes first guide member 22 connected to first region 24F and second region 24G of fin 24, the water generated on first region 24F and second region 24G during defrosting operation can be efficiently drained downward in first direction A through first end 22A of first guide member 22 and indentation 40. That is to say, outdoor heat exchanger 5 according to Embodiment 2 can achieve effects similar to those of outdoor heat exchanger 5 according to Embodiment 1.

It suffices that at least a part of the portion of first guide member 22 which is received in first cut-away portion 51 is configured appropriately as long as an interval can be formed between first cut-away portion 51 and first guide member 22. First guide member 22 may have, for example, any of the configurations shown in FIGS. 8(*c*) to (*i*).

Embodiment 3

Figure 12:
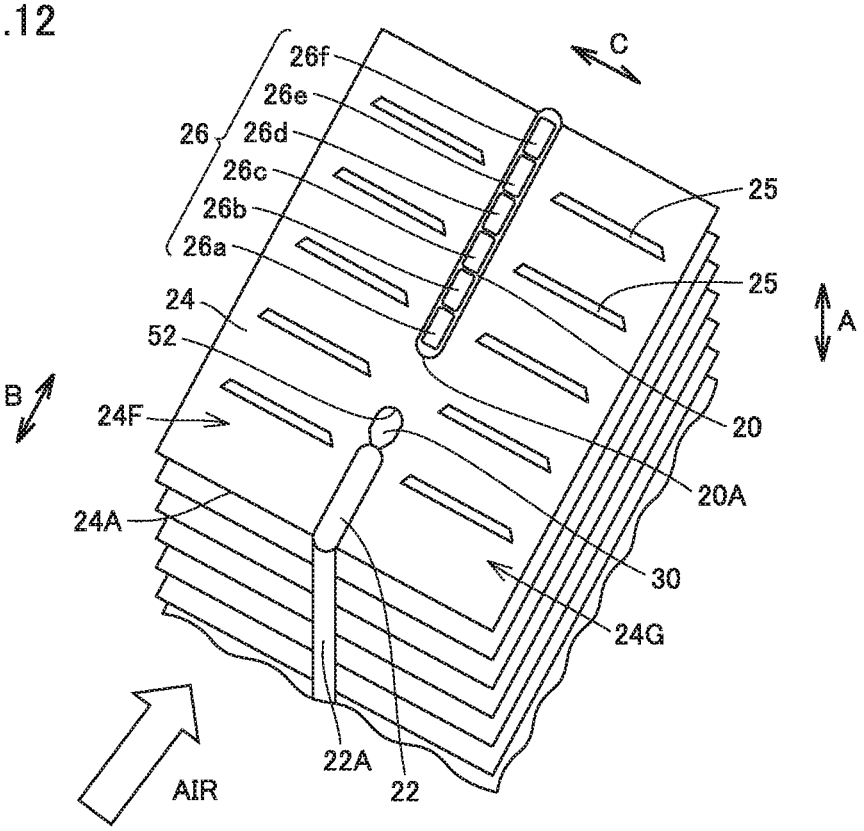
FIG. 12 is a partially enlarged view of a heat exchanger according to Embodiment 3.
Figure 13:
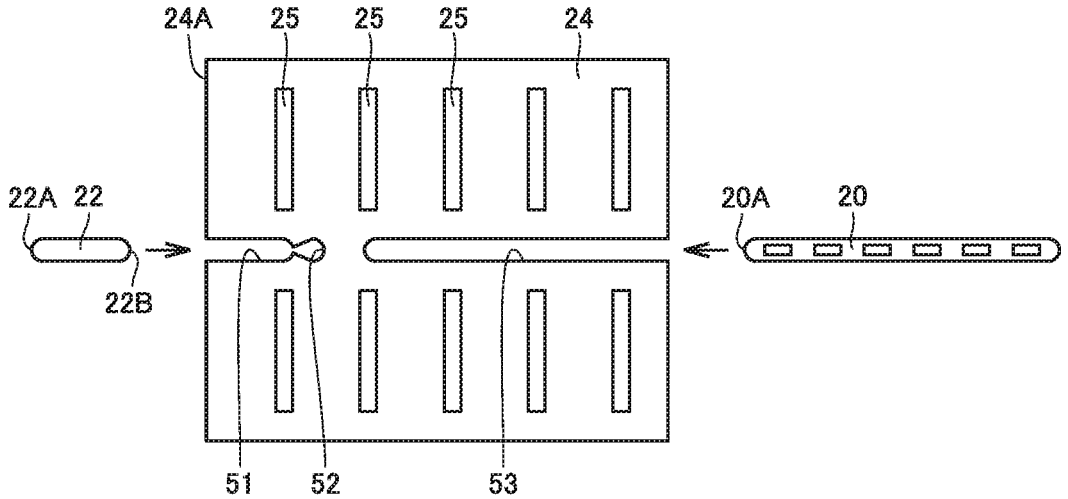
FIG. 13 is a partially enlarged view showing a relationship in which a heat transfer tube and a first guide member are connected to a fin in the heat exchanger according to Embodiment 3.

An outdoor heat exchanger according to Embodiment 3 will now be described with reference to FIGS. 12 and 13. The outdoor heat exchanger according to Embodiment 3 basically has a configuration similar to that of outdoor heat exchanger 5 according to Embodiment 2 but differs therefrom in that fin 24 is provided with a second cut-away portion 52 connected to first cut-away portion 51.

Second cut-away portion 52 is provided in each of fins 24 layered in first direction A. Second cut-away portions 52 have, for example, the same configuration. Second cut-away portions 52 are provided to overlap one another in, for example, first direction A.

Second cut-away portion 52 is provided leeward of, for example, first cut-away portion 51. The end of second cut-away portion 52 which is located windward is connected to the end of first cut-away portion 51 which is located leeward. Second cut-away portion 52 is not provided so as to receive first guide member 22. The width of the end of second cut-away portion 52 which is located windward in third direction C is smaller than the width of first guide member 22 in third direction C.

The surface of a part of second end 22B of first guide member 22 inserted into first cut-away portion 51 faces second cut-away portion 52 of fin 24. The surface of the part of first guide member 22 which faces second cut-away portion 52 is provided to extend in first direction A and is not connected to fin 24. That is to say, the first surface of first guide member 22 has the surface of first end 22A and the surface of the part of first guide member 22.

The outdoor heat exchanger according to Embodiment 3 can thus achieve effects similar to those of the outdoor heat exchanger according to Embodiment 2.

Although second cut-away portion 52 is preferably connected to first cut-away portion 51 leeward of first cut-away portion 51, it may be connected to any location of first cut-away portion 51.

The outdoor heat exchangers according to Embodiment 2 and Embodiment 3 may further include a heat transfer tube leeward of heat transfer tube 20. For example, a heat transfer tube and a fin that have configurations similar to those of heat transfer tube 20 and tin 24 shown in FIGS. 10 to 13 may be disposed leeward of heat transfer tube 20 and fin 24. Also with such a configuration, the effects similar to those of the outdoor heat exchangers according to Embodiment 2 and Embodiment 3 can be achieved.

Although the heat exchangers (outdoor heat exchangers) according to Embodiments 1 to 3 are suitable for air conditioners as described above, the present invention is not limited thereto. The heat exchanges according to Embodiments 1 to 3 are applicable to, for example, apparatuses that employ a heat pump that compresses refrigerant by a compressor and circulates the compressed refrigerant, such as a heat pump water heater or a refrigerator.

It should be understood that the embodiments disclosed herein are illustrative and non-restrictive in every respect. It is therefore intended that the scope of the present invention is defined by claims, not only by the embodiments described above, and encompasses all modifications and variations equivalent in meaning and scope to the claims.

INDUSTRIAL APPLICABILITY

The present invention is particularly advantageously applied to an air conditioner which is subjected to heating operation in cold weather and a heat exchanger included in the air conditioner.

REFERENCE SIGNS LIST

1 compressor, 2 four-way valve, 3 indoor heat exchanger, 4 expansion valve, 5 outdoor heat exchanger, 6 indoor fan, 7 outdoor fan, 10 first distributor, 11 second distributor, 12 folded header, 20, 21 heat transfer tube, 20A third end, 20B fourth end, 21A seventh end, 21B eighth end, 22 first guide member, 22A first end, 22B second end, 23 second guide member, 23A fifth end, 23B sixth end, 24 fin, 24A ninth end, 24B tenth end, 25 louver, 40, 41, 42 indentation, 43 base material, 44 coating film, 51 first cut-away portion, 52 second cut-away portion, 53 third cut-away portion.

The invention claimed is:

1. A heat exchanger comprising:

at least one heat transfer tube, which is provided to extend in a first direction and in which refrigerant flows;

a fin connected to the at least one heat transfer tube and having a first region and a second region, which are located windward of a windward end of the at least one heat transfer tube in a second direction crossing the first direction; and a first guide member provided to extend in the first direction, the first region and the second region being spaced apart from each other in a third direction crossing the first direction and the second direction, the first guide member being disposed between the first region and the second region in the third direction, among the at least one heat transfer tube and the first guide member, the first guide member being disposed most windward in the second direction, the first guide member being provided so as to not allow the refrigerant to flow therethrough; and a first hollow space is provided between the first guide member and the heat transfer tube in the second direction, and the first hollow space faces lateral ends of the first region and the second region in the third direction.

2. The heat exchanger according to claim 1, wherein the fin comprises a first fin portion and a second fin portion which are disposed with the at least one heat transfer tube therebetween in the third direction, and the first region is formed on the first fin portion and the second region is formed on the second fin portion.

3. The heat exchanger according to claim 1, wherein the fin has a first cut-away portion configured to receive the first guide member, the first region and the second region are disposed with the first cut-away portion therebetween in the third direction, and the first guide member is disposed in the first cut-away portion.

4. The heat exchanger according to claim 3, wherein the fin has a second cut-away portion connected to the first cut-away portion.

5. The heat exchanger according to claim 1, wherein the first guide member has a first surface that extends in the first direction and that is not directly connected to the fin.

6. The heat exchanger according to claim 5, wherein the first guide member has an indentation, and the first surface has an inner circumferential surface of the indentation.

7. The heat exchanger according to claim 5, wherein the first direction extends vertically, and the first guide member is provided such that a length of the first surface in a cross-section perpendicular to the first direction increases toward downward in the first direction.

8. The heat exchanger according to claim 1, comprising:

a plurality of the at least one heat transfer tubes spaced apart from each other in the second direction; and at least one second guide member provided to extend in the first direction, wherein the at least one second guide member is disposed between and spaced apart from two heat transfer tubes adjacent to each other in the second direction among the plurality of heat transfer tubes, the at least one second guide member being disposed adjacent to the fin, and the at least one second guide member has a second surface that extends in the first direction and that is not directly connected to the fin.

9. The heat exchanger according to claim 1, wherein an area of a cross-section of the at least one heat transfer tube perpendicular to the first direction is greater than an area of a cross-section of the first guide member perpendicular to the first direction.

10. The heat exchanger according to claim 1, wherein an outer surface of the first guide member comprises a base material and a coating film covering an outer surface of the base material, and a material of the coating film is more hydrophilic than a material of a surface of the fin.

11. An air conditioner comprising:

a heat exchanger according to claim 1; and a fan configured to blow gas to the heat exchanger in the second direction.

12. The heat exchanger according to claim 5, wherein the first guide member has a second surface that extends in the first direction and that is not directly connected to the at least one heat transfer tube.

13. The heat exchanger according to claim 1, wherein the first guide member has a windward end and a leeward end, which are located windward of the windward end of the at least one heat transfer tube.

* * * * *